US006872430B2

(12) United States Patent
Burch et al.

(10) Patent No.: US 6,872,430 B2
(45) Date of Patent: Mar. 29, 2005

(54) POROUS INKJET RECEIVER LAYER WITH A BINDER GRADIENT

(75) Inventors: Eric L Burch, San Diego, CA (US); Pierre-Alain Brugger, Ependes (CH); Martin Staiger, Clarens (CH)

(73) Assignee: Hewlett-Packard Development Company, L.P., Houston, TX (US)

( * ) Notice: Subject to any disclaimer, the term of this patent is extended or adjusted under 35 U.S.C. 154(b) by 44 days.

(21) Appl. No.: 10/159,250

(22) Filed: May 31, 2002

(65) Prior Publication Data

US 2003/0224127 A1 Dec. 4, 2003

(51) Int. Cl.[7] ..... B41M 5/00

(52) U.S. Cl. ..... 428/32.1; 428/32.24; 428/195.1; 428/32.15; 428/32.25; 428/411.1

(58) Field of Search ..... 428/32.1, 32.24, 428/32.15, 32.25, 195.1, 411.1

(56) References Cited

U.S. PATENT DOCUMENTS

| | | | |
|---|---|---|---|
| 5,609,964 | A | 3/1997 | Ogawa et al. |
| 5,635,297 | A | 6/1997 | Ogawa et al. |
| 6,156,419 | A | 12/2000 | Brugger et al. |
| 6,177,177 | B1 | 1/2001 | Herrmann et al. |
| 6,605,336 | B2 * | 8/2003 | Ichinose et al. ..... 347/105 |
| 2002/0054982 | A1 | 5/2002 | Dietrich et al. |

FOREIGN PATENT DOCUMENTS

| | | | |
|---|---|---|---|
| EP | 0878322 | A2 | 11/1998 |
| EP | 0947349 | A2 | 10/1999 |
| EP | 114735 | A2 | 7/2001 |
| WO | WO99/21724 | | 5/1999 |
| WO | WO03/059637 | | 7/2003 |

OTHER PUBLICATIONS

Hens, Jules and Willy Van Abbenyen, "Slide Coating," Liquid Film Coating: Scientific Principles and their Technological Implications, ed. Stephan Kistler and Peter Schweizer, p. 11b, Chapman & Hall, London,1997.

Miyamoto, Kimniaki and Yoshinobu Katagiri, "Curtain Coating," Liquid Film Coating: Scientific Principles and their Technological Implications, ed. Stephan Kistler and Peter Schweizer, p. 11c, Chapman & Hall, London, 1997.

* cited by examiner

*Primary Examiner*—Rena Dye
*Assistant Examiner*—Tamra L. Dicus

(57) ABSTRACT

An ink jet inkjet receiver layer on a substrate consists of at least two layers of similar composition of binder and pigment, except that the layer next to the substrate has a smaller pigment/binder ratio versus the layer laid on top of it. Multiple layers making up the gradient are included.

18 Claims, 1 Drawing Sheet

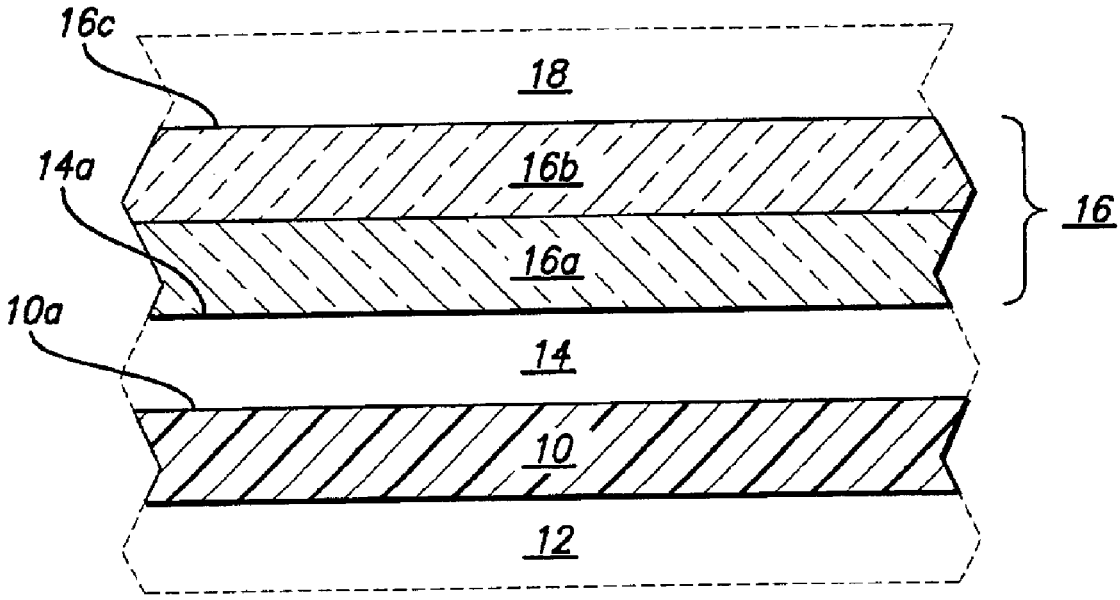
16c
18
14a
16b
16
16a
10a
14
10
12

POROUS INKJET RECEIVER LAYER WITH A BINDER GRADIENT

TECHNICAL FIELD

The present invention relates generally to printing media used in inkjet printing, and, more particularly, to coatings on such print media having both good adhesion to a supporting substrate and good ink absorption characteristics.

BACKGROUND ART

In recent years, as digital cameras and other devices having color output have advanced, the technology has attempted to keep pace in order to record images on paper sheets or the like. The ultimate goal of such recorded images ("hard copy") is silver halide photography, and it is desired to provide recorded images from such devices that have the color reproduction, image density, gloss, etc. as close to those of silver halide photography as possible.

The technology of inkjet color printing has attempted to keep pace with the development of digital cameras and other color output devices, but improvements are continually sought in order to be competitive with silver halide images.

Most coatings on print media used for color inkjet printing consist of discrete layers with dissimilar compositions. These compositions typically comprise one or more binders and one or more pigments. Binders are used to secure the pigment to the substrate or to a lower layer. Pigments are present in the binder as particles, and are used to form a porous medium for absorbing liquid from the ink. Thus, as the ink is printed on the print media, the uppermost layers serve to retain the ink colorant close to the surface, to maximize color gamut, while the lowermost layers serve to absorb the liquids in the ink to reduce dry time.

The foregoing approach is disadvantageous, however, as multiple raw materials and mixing vessels must be used to produce these coatings. Also, compatibility between layers must be designed or otherwise taken into account; otherwise, incompatibilities between layers may result. Examples of such incompatibilities include gelling and delamination.

There are competing issues that affect the nature and composition of the coatings formed on print media. It is desired that the coating adhere well to the supporting substrate. It is also desired that the coating exhibit good ink absorption characteristics. Often, an improvement of one of these properties causes a degradation of the other property, such that it is possible to have a coating composition that adheres well to the substrate, but has poor ink absorption characteristics, and vice versa.

Thus, there is a need for a coating that evidences both good adhesion to the substrate and good ink absorption.

DISCLOSURE OF INVENTION

In accordance with the embodiments disclosed herein, a recording sheet for ink jet printing is provided. The recording sheet comprises a support, or substrate, having coated thereover an inkjet receiver layer. The inkjet receiver layer has a lower-most portion over the support and an upper-most portion and comprises at least one binder and at least one pigment. The binder is the same throughout the inkjet receiver layer and/or the pigment is also the same throughout the inkjet receiver layer. A gradient in the ratio of binder to pigment is provided, the gradient ranging from more binder and less pigment in the lower-most portion of the inkjet receiver layer to less binder and more pigment in the upper-most portion. Thus, there is more binder adjacent the support, decreasing to a lower value at the top of the inkjet receiver layer.

Also in accordance with the embodiments disclosed herein, a method of fabricating a recording sheet for ink jet printing is provided. The method comprises:

(a) providing the support; and (b) forming the inkjet receiver layer over the support, wherein the inkjet receiver is formed with the gradient in ratio of binder to pigment as described above.

Use of the binder gradient allows the inkjet receiving layer to have good adhesion to the substrate with a binder-rich layer, but have good inkjet absorption characteristics with pigment-rich layers near the surface. This construction also allows high coatweights to be manufactured while avoiding the cracking and film formation issues associated with high coatweights.

The binder gradient approach herein has the advantage of good adhesion to the substrate, good manufacturability at high coatweights, good image quality, and good ink adsorption, without needing a large raw material set and complicated mixing processes.

BRIEF DESCRIPTION OF THE DRAWINGS

The sole FIGURE depicts one embodiment of the gradient in binder composition for a print medium having an inkjet receiver thereon.

BEST MODES FOR CARRYING OUT THE INVENTION

Reference is now made in detail to specific embodiments of the present invention, which illustrates the best mode presently contemplated by the inventors for practicing the invention. Alternate embodiments are also briefly described as applicable.

In accordance with the embodiments disclosed herein, an inkjet receiver layer on a substrate comprises a binder and a pigment, wherein the inkjet receiver layer is provided with a concentration gradient in the binder composition. The sole FIGURE depicts one embodiment of the inkjet receiver layer on a substrate. Specifically, a substrate or support 10 is provided.

The usual supports used in the manufacture of transparent or opaque photographic material may also be employed in the practice of the present invention. Examples include, but are not limited to, clear films, such a cellulose esters, including cellulose triacetate, cellulose acetate, cellulose proprionate, or cellulose acetate butyrate, polyesters, including poly(ethylene terephthalate), polyimides, polycarbonates, polyamides, polyolefins, poly(vinyl acetals), polyethers, polyvinyl chloride, and polysulfonamides. Polyester film supports, and especially poly(ethylene terephthalate), such as manufactured by du Pont de Nemours under the trade designation of MELINEX, are preferred because of their excellent dimensional stability characteristics. Opaque photographic materials include, for example, baryta paper, polyethylene-coated papers, and voided polyester. Especially preferred are resin-coated paper or voided polyester.

Non-photographic materials, such as transparent films for overhead projectors, may also be used for the support material. Examples of such transparent films include, but are not limited to, polyesters, diacetates, triacetates, polystyrenes, polyethylenes, polycarbonates, polymethacrylates, cellophane, celluloid, polyvinyl chlorides, polyvinylidene chlorides, polysulfones, and polyimides.

Additional support materials include plain paper of various different types, including, but not limited to, pigmented papers and cast-coated papers, as well as metal foils, such as foils made from alumina.

However, the embodiments disclosed herein are especially efficacious when used with high-gloss film and transparency substrates, as these materials are known to be difficult to coat and adhere to, inasmuch as their surface is very smooth, which results in a small interface area between the coating and the substrate (or subbing layer) and reduced mechanical interlocking adhesion.

The substrate 10 may be provided with an optional backing layer 12. Such backing layers are well known, and include, for example, a synthetic polymer latex, including homopolymers and copolymers of vinyl acetate, styrene, ethylene, vinyl chloride, acrylic acid, isobutylene, chloroprene, butadiene, acrylonitrile, methyl methacrylate, acrylate esters, and these polymers which are modified with carboxyl group, together with one or more binders and one or more pigments, as disclosed in, for example, U.S. Pat. Nos. 5,609,964 and 5,635,297, the contents of which are incorporated herein by reference. Such backing layer 12 is used to control curl or friction or "feel".

The use of certain support materials, such as polyesters, is beneficially improved with use of a subbing layer 14, which improves the bonding of the ink-receiving layer, described below, to the support 10. Useful subbing compositions for this purpose are well known in the photographic art and include, for example, terpolymers of vinylidene chloride, acrylonitrile, and acrylic acid or of vinylidene chloride, methyl acrylate, itaconic acid, and natural polymers such as gelatin The inkjet receiver layer 16 is formed on the substrate 10 (or subbing layer 14, as the case may be) and, as mentioned above, includes one or more binders and one or more pigments.

The binders are normally water-soluble or water-dispersible. Especially preferred are film-forming polymers, natural or synthetic. The amount of binder in the inkjet receiver 16 ranges from about 5 to 50 wt % relative to the pigment and binder.

Examples of water-soluble polymers useful as binders include, for example, natural polymers or modified products thereof such as albumin; gelatin; casein; starch; gum arabic; sodium or potassium alginate; hydroxyethylcellulose; carboxymethylcellulose; α-, β-, or γ-cyclodextrin; and the like. In the case where one of the water-soluble polymers is gelatin, all known types of gelatin may be used, such as, for example, acid pigskin or limed bone gelatin, acid- or base-hydrolyzed gelatin, as well as derivatized gelatins such as phthalaoylated, acetylated, or carbamoylated gelatin or gelatin derivatized with the anhydride of trimellytic acid. A preferred natural binder is gelatin.

Synthetic polymers are also used and include, but are not limited to, polyvinyl alcohol; completely or partially saponified products of copolymers of vinyl acetate and other monomers; homopolymers of or copolymers with monomers of unsaturated carboxylic acids such as (meth)acrylic acid, maleic acid, crotonic acid, and the like; and homopolymers of or copolymers with vinyl monomers of sulfonated vinyl monomers such as vinylsulfonic acid, styrene sulfonic acid, and the like. Additional synthetic polymers include homopolymers of or copolymers with vinyl monomers of (meth)acrylamide; homopolymers or copolymers of other monomers with ethylene oxide; polyurethanes; polyacrylamides; water-soluble nylon-type polymers; polyvinyl pyrrolidone; polyesters; polyvinyl lactams; acrylamide polymers; substituted polyvinyl alcohol; polyvinyl acetals; polymers of alkyl and sulfoalkyl acrylates and methacrylates; hydrolyzed polyvinyl acetates; polyamides; polyvinyl pyridines; polyacrylic acid; copolymers with maleic anhydride; polyalkylene oxides; methacrylamide copolymers; and maleic acid copolymers. All these polymers can also be used as mixtures. A preferred synthetic binder is polyvinyl alcohol.

The inkjet receiver 16 may contain in addition to the binder and pigment a crosslinking agent for the binder as well as fillers, natural or synthetic polymers or other compounds well known to someone skilled in this art to improve the pictorial or physical properties of the image, such as for example UV absorbers, optical brighteners, light stabilizers, antioxidants, humefactants, surfactants, spacing agents, plasticizers, and the like. The thickness of the inkjet receiver layer ranges from about 0.5 to 100 μm dry thickness, and preferably from about 15 to 60 μm.

The pigment in the inkjet receiver layer 16 may comprise any number of white pigment materials well known in this art. Examples of suitable inorganic white pigments include, but are not limited to, precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, modified aluminas, lithopone, zeolite, hydrated halloysite, magnesium carbonate, and magnesium hydroxide. Examples of suitable organic white pigments include, but are not limited to, styrene plastics pigment, acrylic plastics pigment, polyethylene, microcapsules, urea resin, and melamine resin.

Porous inorganic pigments are preferred as white pigments to be contained in the inkjet receiver layer. Of the foregoing, porous alumina is more preferred, and pseudo-boehmite is most preferred. As is well known, pseudo-boehmite is aluminum oxide/hydroxide ($Al_2O_3.n\ H_2O$ where n is from 1 to 1.5). Most preferably, the inkjet receiver layer comprises rare earth-modified boehmite containing from about 0.04 to 4.2 mole percent of at least one rare earth metal having an atomic number from 57 to 71 of the Periodic Table of Elements, in order to improve lightfastness. Preferably, the rare earth elements are selected from the group consisting of lanthanum, ytterbium, cerium, neodymium, and praseodymium. Most preferably, the rare earth elements are selected from the group consisting of lanthanum, cerium, and ytterbium and mixtures thereof. The presence of the rare earth changes the pseudo-boehmite structure. The presence of the rare earth element provides superior lightfastness, compared with an alumina inkjet receiver not including the rare earth element.

The preparation of the pseudo-boehmite layer modified with rare earths is more fully described in U.S. Pat. No. 6,156,419, the contents of which are incorporated herein by reference.

In accordance with teachings herein, a gradient is provided in the binder concentration in the inkjet receiver layer 16. Specifically, the binder gradient is prepared by adjusting the pigment/binder ratio such that the ratio in the layer next to the substrate (lower-most portion or layer) is low and increasing this ratio as additional layers are added to the previous layer, to form an upper-most layer portion or layer.

Preferably, the ratio of percent (weight) binder to pigment and binder in the inkjet receiver layer is within the range of about 2 to 50%, and more preferably within the range of about 4 to 30%. When the pigment comprises alumina or its derivatives, the preferred percent binder in the top layer of the gradient is within the range of about 3 to 16 wt %, and more preferably, about 3 to 8 wt % if relatively absorption of ink is desired, or more preferably, about 9 to 16 wt % if relatively higher color gamut or greater coating strength/integrity is desired. When the pigment comprises silica or its derivatives, the preferred binder percent in the top layer of the gradient is within the range of about 6 to 25 wt %, while the more preferred range is 7 to 15 wt %.

The binder gradient is measured by first calculating the percent of the binder for the total weight of the pigment and binder, then dividing the value for the percent binder in the bottom layer by that in the top layer. Preferably the binder gradient is the range of 1.1 to 20, and more preferably in the range of 1.2 to 4.

In one embodiment, depicted in the sole FIGURE, the inkjet receiver layer 16 comprises two layers 16*a*, 16*b*, with layer 16*a* comprising a relatively higher concentration of binder and layer 16*b* comprising a relatively lower concentration of binder. Other configurations are also possible, including (1) a plurality of layers, each layer having a lower concentration of binder than the layer immediately below it, and (2) a single layer having a continuously-varying gradient in binder concentration from the interface 10*a* with the substrate 10 to the top of the inkjet receiver layer 16*c*, and (3) combinations of these.

The preferred coating method is from a multi-slot coater whereby the layers are applied simultaneously in a single pass. Such multi-slot coaters are well known in this art, and include cascade coating and curtain coating. Incompatibilities between layers are avoided with this coating method. However, other coating methods may also be used to provide the concentration gradient.

As the binder concentration decreases away from the substrate 10, the pigment concentration increases correspondingly. More specifically, the ratio of the binder to pigment is higher at the interface 10*a* with the substrate 10 (or with the interface 14*a* with the subbing layer 14) and lower at the top surface 16*c* of the inkjet receiver layer 16.

Use of the binder gradient allows the inkjet receiver layer 16 to have good adhesion to the substrate 10 with a binder-rich layer, but have good inkjet absorption characteristics with pigment-rich layers near the surface 16*c*. This construction also allows large coatweights to be manufactured while avoiding the cracking and film formation issues associated with high coatweights.

An optional topcoat layer 18 may be formed on the top of the inkjet receiver layer 16. The topcoat layer 18 may be used to provide scratch resistance. Ordinarily, the topcoat layer, often denoted the ink-transport layer, is used to retain the colorant from the ink jet ink, while the solvent component of the ink jet ink moves to the inkjet receiver layer, often denoted the ink-receiving layer. In the configuration disclosed and claimed herein, the colorant is retained in the uppermost inkjet receiver layer, here, layer 16*b*, while the solvent component moves to the lowermost inkjet receiver layer, here, layer 16*a*.

Any of the materials commonly employed in topcoat layers may be utilized as the optional topcoat layer 18. Examples include, but are not limited to, the same list of pigments as for the inkjet receiver 16, except that the topcoat 18 has a different pigment than the inkjet receiver 16.

As a preferred example, useful with ink jet inks containing water-based anionic dyes as the colorant, the topcoat layer 18 comprises binder-free, colloidal cationic silica formed on top of the inkjet receiver layer 16. By "binder-free" is meant that less than 4 wt % of pigment (silica) comprises a binder material deliberately added to the pigment, preferably, less than 1 wt %, and most preferably, 0 wt %.

The silica topcoat 18 comprises particles that have a particle size within the range of about 5 to 500 nm, preferably about 10 to 100 nm. The thickness of the topcoat layer 18 is within the range of about 0.05 to 5 $\mu$m, preferably about 0.1 to 2 $\mu$m. Colloidal cationic silica is commercially available from a variety of vendors, including Clariant Corp. (Charlotte, N.C.) available under the following tradenames: Cartacoat 302C, Cartacoat 303C, Snowtex O, Snowtex OL, and Snowtex OXS, among others. The topcoat may contain any of the same additional components as listed above for the inkjet receiver.

The inkjet receiver layer disclosed and claimed herein is intended for use with ink jet inks. Such inks, as is well known, comprise at least one colorant and a vehicle. The use of the cationic silica is intended for use with dye-based inks, specifically, anionic dyes. Such anionic dyes are, per se, well known, and any of the anionic dyes employed in ink jet inks, including color and black, may be advantageously utilized in the practice of the embodiments disclosed herein. Indeed, the recording sheet herein is preferably employed in conjunction with ink jet inks containing anionic dyes, and beneficially improves the properties of such inks upon printing, due to the presence of the cationic silica topcoat. Preferably, carboxylate and sulfonate anionic dyes are employed in the ink jet inks used in conjunction with the recording sheet disclosed and claimed herein. However, where the topcoat layer 18 is other than colloidal cationic silica, then ink jet inks containing anionic dyes as well as other colorants may be employed. Examples of such other colorants include, but are not limited to, solvent- or water-soluble anionic and cationic dyes, as well as pigments, whether dispersed or self-dispersed.

In formulating the ink-jet inks used with the recording sheet disclosed and claimed herein, water, alone or together with one or more co-solvents, may be employed in the vehicle. These co-solvents are substantially water-miscible. Classes of co-solvents employed in the practice of this invention include, but are not limited to, aliphatic alcohols, aromatic alcohols, diols, glycol ethers, poly(glycol) ethers, caprolactams, formamides, acetamides, and long chain alcohols. Examples of generic co-solvents employed in the inks include, but are not limited to, primary aliphatic alcohols of 30 carbons or less, primary aromatic alcohols of 30 carbons or less, secondary aliphatic alcohols of 30 carbons or less, secondary aromatic alcohols of 30 carbons or less, 1,2-alcohols of 30 carbons or less, 1,3-alcohols of 30 carbons or less, 1,ω-alcohols of 30 carbons or less, ethylene glycol alkyl ethers, propylene glycol alkyl ethers, poly(ethylene glycol) alkyl ethers, higher homologs of poly(ethylene glycol) alkyl ethers, poly(propylene glycol) alkyl ethers, higher homologs of poly(propylene glycol) alkyl ethers, N-alkyl caprolactams, unsubstituted caprolactams, substituted formamides, unsubstituted formamides, substituted acetamides, and unsubstituted acetamides. Specific examples of co-solvents that are preferably employed in the inks include, but are not limited to, N-methyl pyrrolidone, 1,5-pentanediol, 2-pyrrolidone, diethylene glycol, 1,3-(2-methyl)-propanediol, 1,3,5-(2-methyl)-pentanetriol, tetramethylene sulfone, 3-methoxy-3-methylbutanol, glycerol, and 1,2-alkyldiols. The co-solvent concentration may range from 0 to about 30 wt %, with about 3 to 15 wt % being preferred.

In addition to the foregoing, various types of additives may be employed in the ink to optimize the properties of the ink for specific applications. For example, as is well-known to those skilled in the art, biocides may be used in the ink to inhibit growth of microorganisms, sequestering agents such as EDTA may be included to eliminate deleterious effects of heavy metal impurities, buffering agents may be used to control the pH of the ink, and acrylic or non-acrylic polymers may be added to condition the ejected ink droplets. Other known additives such as viscosity modifiers, e.g., surfactants, optical brighteners, UV absorbers, light stabilizers, ink penetration agents, leveling agents, and drying agents, may be added to improve various properties of the ink compositions as desired. The organic components have, in most cases, a boiling point that is higher than that of water.

The colorants suitable for the preparation of inks useable with the recording sheets disclosed and claimed herein cover practically all classes of known coloring compounds. The recording sheets herein are meant to be used in conjunction with most of the inks representing the state of the art.

EXAMPLES

Examples 1–8

A series of recording sheets were prepared as follows: a substrate comprising a resin-coated photobase material (Examples 1–4) or a MELINEX film (a polyester terephthalate) was coated with an inkjet receiver comprising aluminum oxide as the pigment (Sasol HP/14) and polyvinyl alcohol as the binder (Mowiol 5698). A gradient was created in each instance (except for Example 1, which had no gradient), wherein the concentration of binder was greater at the substrate and decreased away from the substrate. Two layers were used to form the gradient in the inkjet receiver. The inkjet receivers formed on the film were further coated with a topcoat containing silica. Specifically, Example 5 and 6 were coated with 1.0 g/m$^2$ Cartacoat 302C (Clariant), which has a mean particle size of 25 nm, while Example 7 and 8 were coated with 1.0 g/m$^2$ Cartacoat 303C (Clariant), which has a mean particle size of 50 nm.

The compositions are listed in Table I below:

TABLE I

Compositions and Gradient in Two-Layer Inkjet receiver.

| Example | layer | g/m$^2$ Sasol HP/14 | Mowiol 5698 | Lactic acid | Lanthanum nitrate | Trimethol-propane | Glycerine | Boric acid | % binder | ratio |
|---|---|---|---|---|---|---|---|---|---|---|
| On Photobase | | | | | | | | | | |
| 1 | top | 13.2 | 1.20 | 0.207 | 0.036 | 0.234 | 0.135 | 0.171 | 8.1 | 1.0 |
| | bottom | 26.4 | 2.30 | 0.423 | 0.081 | 0.477 | 0.261 | 0.342 | 8.2 | |
| 2 | top | 13.5 | 1.22 | 0.216 | 0.045 | 0.126 | 0.135 | 0.162 | 8.3 | 1.2 |
| | bottom | 27 | 3.00 | 0.441 | 0.090 | 0.243 | 0.279 | 0.324 | 9.9 | |
| 3 | top | 18 | 1.22 | 0.297 | 0.063 | 0.099 | 0.135 | 0.216 | 6.3 | 1.4 |
| | bottom | 18 | 1.80 | 0.297 | 0.063 | 0.099 | 0.135 | 0.216 | 9.1 | |
| 4 | top | 18 | 1.22 | 0.297 | 0.063 | 0.099 | 0.135 | 0.216 | 6.3 | 2.1 |
| | bottom | 18 | 2.70 | 0.297 | 0.063 | 0.099 | 0.135 | 0.216 | 13.0 | |
| On Film | | | | | | | | | | |
| 5 | top | 9 | 0.675 | 0.18 | 0.036 | 0.063 | 0.099 | 0.108 | 7.0 | 1.6 |
| | bottom | 27 | 3.384 | 0.522 | 0.09 | 0.189 | 0.27 | 0.324 | 11.1 | |
| 6 | top | 9 | 0.675 | 0.18 | 0.036 | 0.063 | 0.099 | 0.108 | 7.0 | 1.6 |
| | bottom | 27 | 3.384 | 0.522 | 0.09 | 0.189 | 0.27 | 0.324 | 11.1 | |
| 7 | top | 13.5 | 1.22 | 0.216 | 0.045 | 0.126 | 0.135 | 0.162 | 8.3 | 1.2 |
| | bottom | 27 | 3.00 | 0.441 | 0.09 | 0.243 | 0.279 | 0.324 | 9.9 | |
| 8 | top | 13.5 | 0.68 | 0.216 | 0.045 | 0.126 | 0.135 | 0.162 | 4.8 | 2.7 |
| | bottom | 27 | 4.05 | 0.441 | 0.09 | 0.243 | 0.279 | 0.324 | 13.0 | |

In each instance, the color gamut was measured following printing on one of two printers: a Hewlett-Packard DeskJet 970 ("Printer 1") and a new color printer, to be released by Hewlett-Packard ("Printer 2"). The recording sheets from the various foregoing examples were printed separately on the two ink jet printers with a standard color pattern, using cyan, magenta, yellow, blue, green red, and black squares.

The results listed in Table II below were obtained with regard to color gamut (CIELAB) for each printer, gloss, and drytime. Color gamut was measured with a Macbeth Color Eye 7000A color spectrophotometer. Gloss was measured at a 20 degree angle with a BYK Gardner Micro-TRI-Gloss. Color smudge was measured immediately after printing by swiping a finger across the print to determine relative dry time and wet coating integrity. Cracking is measured by rolling the media into a tube diameter small enough to cause cracking in the coating.

A higher color gamut is preferred to a lower color gamut; the higher the color gamut number, the more colorful the print. The gamut units are in CIELAB units multiplied by 0.001. A value of lower than 370 is considered to be dull, while a value of 400 is considered to be very colorful.

A higher gloss is preferred to a lower gloss.

The color smudge, which is a visual evaluation of the degree of wet ink smudged immediately after printing, is provided on a scale of 1 to 5, with 5 being excellent and 1 being poor, The coating cracking after rolling into a tube of sufficient diameter to cause cracking (~0.5 inches) is also judged on a visual scale with 5 being excellent and 1 being poor.

TABLE II

Results of Printing.

| Example | Gradient | Gamut - Printer 1 | Gamut - Printer 2 | Gloss | Dry-time | Cracking |
|---|---|---|---|---|---|---|
| Photo-base | | | | | | |
| 1 | 1.0 | 368 | 360 | 25 | 5 | 4 |
| 2 | 1.2 | 367 | 350 | 28 | 5 | 5 |

TABLE II-continued

Results of Printing.

| Example | Gradient | Gamut - Printer 1 | Gamut - Printer 2 | Gloss | Dry-time | Cracking |
|---|---|---|---|---|---|---|
| 3 | 1.4 | 376 | 372 | 27 | 4 | 4.5 |
| 4 | 2.1 | 380 | 375 | 30 | 4.5 | 5 |
| 302C Top-coat | | | | | | |
| 5 | 1.6 | 404 | 427 | 52.5 | 5 | 5 |
| 6 | 1.6 | 407 | 386 | 45 | 5 | 5 |
| 303C Top-coat | | | | | | |
| 7 | 1.2 | 371 | 367 | 34 | 5 | 5 |
| 8 | 2.7 | 411 | 403 | 34 | 5 | 4 |

A number of observations may be made: (1) the presence of the Clariant 303C topcoat provided a further boost in gamut, while maintaining the same gloss (The Cartacoat 302C is a smaller particle which provides a higher gloss); and(2) excellent color smudge and cracking performance is retained, but color gamut is increased using the binder gradient.

INDUSTRIAL APPLICABILITY

Thus, there has been disclosed a recording sheet for receiving ink, such as from an ink jet printer, having improved properties.

What is claimed is:

1. A recording sheet for ink jet printing comprising a support having coated over said support an inkjet receiver layer, said support comprising a high gloss and non-absorbent substrate selected from the group consisting of resincoated papers, voided polyesters, high gloss films, and transparency substrates, said inkjet receiver layer having a lower-most portion over said support and an upper-most portion and comprising at least one binder and at least one pigment, wherein said at least one binder is the same in said inkjet receiver layer or wherein said at least one pigment is the same in said inkjet receiver layer, or both are each the same in said inkjet receiver layer, with a gradient in ratio of binder to pigment ranging from more binder and less pigment in said lower-most portion to less binder and more pigment in said upper-most portion.

2. The recording sheet of claim 1 wherein said inkjet receiver layer is coated on said support, and an interface exists between said lower-most portion and said support.

3. The recording sheet of claim 1 wherein a subbing layer is interposed between said support and said inkjet receiver, and an interface exists between said lower-most portion and said subbing layer.

4. The recording sheet of claim 1 wherein said binder is either (a) a natural product or modified product thereof selected from the group consisting of albumin, gelatin; casein; starch; gum arabic; sodium or potassium alginate; hy-droxyethylcellulose; carboxymethylcellulose; α-cyclodextrin, β- cyclodextrin, and γ-cyclodextrin; (b) a synthetic polymer selected from the group consisting of polyvinyl alcohol; completely or partially saponified products of copolymers of vinyl acetate and other monomers; homopolymers of or copolymers with monomers of unsaturated carboxylic acids; homopolymers of or copolymers with vinyl monomers of sulfonated vinyl monomers; homopolymers of or copolymers with vinyl monomers of (meth)acrylamide; homopolymers or copolymers of other monomers with ethylene oxide; polyurethanes; polyacrylamides; water-soluble nylon-type polymers; polyvinyl pyrrolidone; polyesters; polyvinyl lactams; acrylamide polymers; substituted polyvinyl alcohol; polyvinyl acetals; polymers of alkyl and sulfoalkyl acrylates and methacrylates; hydrolyzed polyvinyl acetates; polyamides; polyvinyl pyridines; polyacrylic acid; copolymers with maleic anhydride; polyalkylene oxides; methacrylamide copolymers; and maleic acid copolymers, and mixtures thereof.

5. The recording sheet of claim 1 wherein said pigment is either (a) an inorganic white pigment selected from the group consisting of precipitated calcium carbonate, ground calcium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, modified aluminas, lithopone, zeolite, hydrated halloysite, magnesium carbonate, and magnesium hydroxide, or (b) an organic white pigment selected from the group consisting of styrene plastics pigment, acrylic plastics pigment, polyethylene, microcapsules, urea resin, and melamine resin.

6. The recording sheet of claim 1 wherein said inkjet receiver comprises at least two layers, a lower-most layer having said more binder and said less pigment and an upper-most layer having said less binder and said more pigment.

7. A recording sheet for ink jet printing comprising a support having coated over said support an inkjet receiver layer, said support comprising a high gloss and non-absorbent substrate selected from the group consisting of resin-coated papers, voided polyesters, high gloss films, and transparency substrates, wherein said inkjet receiver layer comprises a single layer comprising at least one binder and at least one pigment and having a continuously-varying gradient in a ratio of binder to pigment that ranges from more binder and less pigment near said support to less binder and more pigment away from said support.

8. The recording sheet of claim 1 wherein said ratio of weight percent binder to pigment is within a range of about 2 to 50%.

9. The recording sheet of claim 8 wherein said ratio is within a range of about 4 to 30%.

10. The recording sheet of claim 8 wherein said pigment comprises an alumina pigment or derivative thereof and wherein said binder has a concentration in said upper-most portion of about 3 to 16 wt %.

11. The recording sheet of claim 10 wherein said concentration is within a range of about 3 to 8 wt %.

12. The recording sheet of claim 10 wherein said concentration is within a range of about 9 to 16 wt %.

13. The recording sheet of claim 8 wherein said pigment comprises a silica pigment or derivative thereof and wherein said binder has a concentration in said upper-most portion of about 6 to 25 wt %.

14. The recording sheet of claim 13 wherein said concentration is within a range of about 7 to 15 wt %.

15. The recording sheet of claim 1 wherein said binder gradient is within a range of 1.1 to 20.

16. The recording sheet of claim 15 wherein said binder gradient is within a range of 1.2 to 4.

17. The recording sheet of claim 1 further including a top layer on said inkjet receiver layer.

18. The recording sheet of claim 17 wherein said top layer includes at least one pigment, said at least one pigment different than that of said pigment in said inkjet receiver layer and optionally includes at least one binder.

* * * * *